US006623008B1

(12) United States Patent
Reed, Jr. et al.

(10) Patent No.: US 6,623,008 B1
(45) Date of Patent: Sep. 23, 2003

(54) GAME AND METHOD OF PLAYING THE SAME

(76) Inventors: John J. Reed, Jr., 1948 Bridge St., Philadelphia, PA (US) 19124; Nancy Jo Reed, 1948 Bridge St., Philadelphia, PA (US) 19124

( * ) Notice: Subject to any disclaimer, the term of this patent is extended or adjusted under 35 U.S.C. 154(b) by 0 days.

(21) Appl. No.: 10/056,450

(22) Filed: Jan. 25, 2002

(51) Int. Cl.[7] ..... A63F 3/00
(52) U.S. Cl. ..... 273/242; 273/153 J
(58) Field of Search ..... 273/236, 242, 273/243, 248, 249, 259, 260, 261, 287, 153 J

(56) References Cited

U.S. PATENT DOCUMENTS

| | | | | | |
|---|---|---|---|---|---|
| 1,406,484 | A | * | 2/1922 | Paris | 273/249 |
| D123,817 | S | * | 12/1940 | Moring | |
| 3,148,886 | A | * | 9/1964 | Sharp | 273/145 R |
| 3,166,325 | A | * | 1/1965 | First | 273/243 |
| 3,395,922 | A | | 8/1968 | Garangiotis | |
| 3,741,546 | A | * | 6/1973 | Chen | 273/249 |
| 4,902,018 | A | * | 2/1990 | Morse | 273/249 |
| 5,067,722 | A | | 11/1991 | Wesner | |
| 5,090,706 | A | * | 2/1992 | Hokanson | 273/146 |
| D325,750 | S | | 4/1992 | Trepanier | |
| 5,386,994 | A | * | 2/1995 | Baranowski | 273/248 |
| 5,433,450 | A | * | 7/1995 | Vaillancourt | 273/248 |
| 5,498,005 | A | | 3/1996 | Jacques | |
| 5,590,883 | A | * | 1/1997 | Brewer | 273/249 |
| 5,692,753 | A | * | 12/1997 | Falk | 273/248 |
| 5,758,876 | A | | 6/1998 | Frick et al. | |
| 6,349,941 | B1 | * | 2/2002 | Cuss | 273/243 |
| 6,394,454 | B1 | * | 5/2002 | Etherington et al. | 273/236 |

* cited by examiner

*Primary Examiner*—Benjamin H. Layno
*Assistant Examiner*—Vishu K Mendiratta

(57) ABSTRACT

A game and method of playing the same for entertaining players. The game and method of playing the same includes a game board having a top surface, a bottom surface and perimeter edge. A game path is positioned on the game board. The game path comprises a plurality of game spaces, four of which are beginning spaces. A plurality of starting positions is positioned on the top surface of the game board and each is located generally adjacent to one of the beginning spaces. Each of a plurality of ending positions is associated with and positioned generally to the right of one of the beginning spaces. A plurality of sets of game pieces is used for moving about the game path. A deck of cards determines movement about the path by the game pieces.

1 Claim, 2 Drawing Sheets

GAME AND METHOD OF PLAYING THE SAME

BACKGROUND OF THE INVENTION

1. Field of the Invention

The present invention relates to games and more particularly pertains to a new game and method of playing the same for entertaining players.

2. Description of the Prior Art

The use of games is known in the prior art. More specifically, games heretofore devised and utilized are known to consist basically of familiar, expected and obvious structural configurations, notwithstanding the myriad of designs encompassed by the crowded prior art which have been developed for the fulfillment of countless objectives and requirements.

Known prior art includes U.S. Pat. No. 5,758,876; U.S. Pat. No. 5,067,722; U.S. Pat. No. 5,498,005; U.S. Pat. No. 3,395,922; U.S. Pat. No. 5,433,450; and U.S. Des. Pat. No. 325,750.

While these devices fulfill their respective, particular objectives and requirements, the aforementioned patents do not disclose a new game and method of playing the same. The inventive device includes a game board having a top surface, a bottom surface and perimeter edge. A game path is positioned on the game board. The game path comprises a plurality of game spaces, four of which are beginning spaces. A plurality of starting positions is positioned on the top surface of the game board and each is located generally adjacent to one of the beginning spaces. Each of a plurality of ending positions is associated with and positioned generally to the right of one of the beginning spaces. A plurality of sets of game pieces is used for moving about the game path. A deck of cards determines movement about the path by the game pieces.

In these respects, the game and method of playing the same according to the present invention substantially departs from the conventional concepts and designs of the prior art, and in so doing provides an apparatus primarily developed for the purpose of entertaining players.

SUMMARY OF THE INVENTION

In view of the foregoing disadvantages inherent in the known types of games now present in the prior art, the present invention provides a new game and method of playing the same construction wherein the same can be utilized for entertaining players.

The general purpose of the present invention, which will be described subsequently in greater detail, is to provide a new game and method of playing the same apparatus and method which has many of the advantages of the games mentioned heretofore and many novel features that result in a new game and method of playing the same which is not anticipated, rendered obvious, suggested, or even implied by any of the prior art games, either alone or in any combination thereof.

To attain this, the present invention generally comprises a game board having a top surface, a bottom surface and perimeter edge. A game path is positioned on the game board. The game path comprises a plurality of game spaces, four of which are beginning spaces. A plurality of starting positions is positioned on the top surface of the game board and each is located generally adjacent to one of the beginning spaces. Each of a plurality of ending positions is associated with and positioned generally to the right of one of the beginning spaces. A plurality of sets of game pieces is used for moving about the game path. A deck of cards determines movement about the path by the game pieces.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new game and method of playing the same apparatus and method which has many of the advantages of the games mentioned heretofore and many novel features that result in a new game and method of playing the same which is not anticipated, rendered obvious, suggested, or even implied by any of the prior art games, either alone or in any combination thereof.

It is another object of the present invention to provide a new game and method of playing the same which may be easily and efficiently manufactured and marketed.

It is a further object of the present invention to provide a new game and method of playing the same which is of a durable and reliable construction.

An even further object of the present invention is to provide a new game and method of playing the same which is susceptible of a low cost of manufacture with regard to both materials and labor, and which accordingly is then susceptible of low prices of sale to the consuming public, thereby making such game and method of playing the same economically available to the buying public.

Still yet another object of the present invention is to provide a new game and method of playing the same which provides in the apparatuses and methods of the prior art some of the advantages thereof, while simultaneously overcoming some of the disadvantages normally associated therewith.

Still another object of the present invention is to provide a new game and method of playing the same for entertaining players.

Yet another object of the present invention is to provide a new game and method of playing the same which includes a game board having a top surface, a bottom surface and perimeter edge. A game path is positioned on the game board. The game path comprises a plurality of game spaces, four of which are beginning spaces. A plurality of starting positions is positioned on the top surface of the game board and each is located generally adjacent to one of the beginning spaces. Each of a plurality of ending positions is associated with and positioned generally to the right of one of the beginning spaces. A plurality of sets of game pieces is used for moving about the game path. A deck of cards determines movement about the path by the game pieces.

Still yet another object of the present invention is to provide a new game and method of playing the same that incorporates card and game board strategy in one game.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
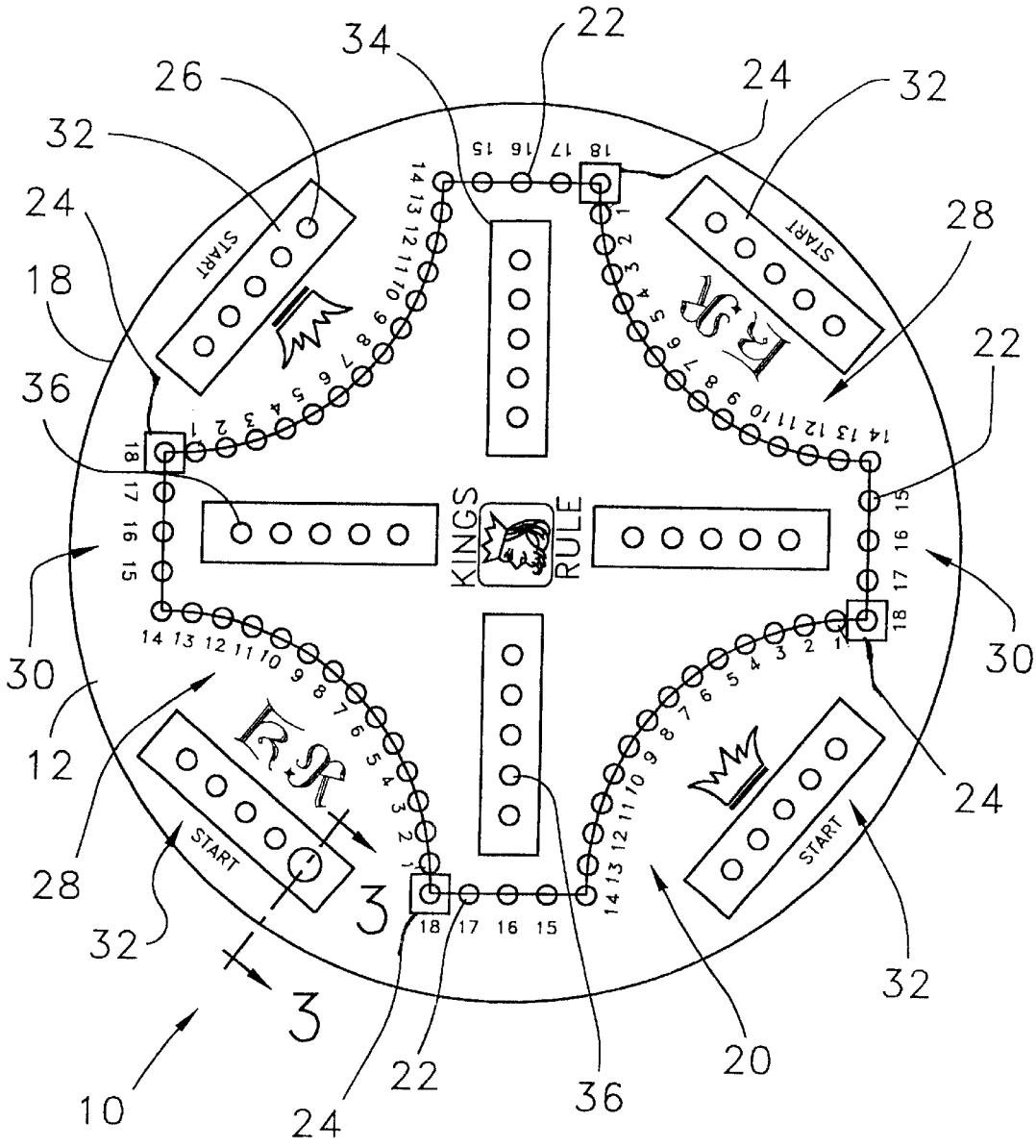
FIG. 1 is a schematic plan view of a game board of a new game and method of playing the same according to the present invention.
Figure 2:
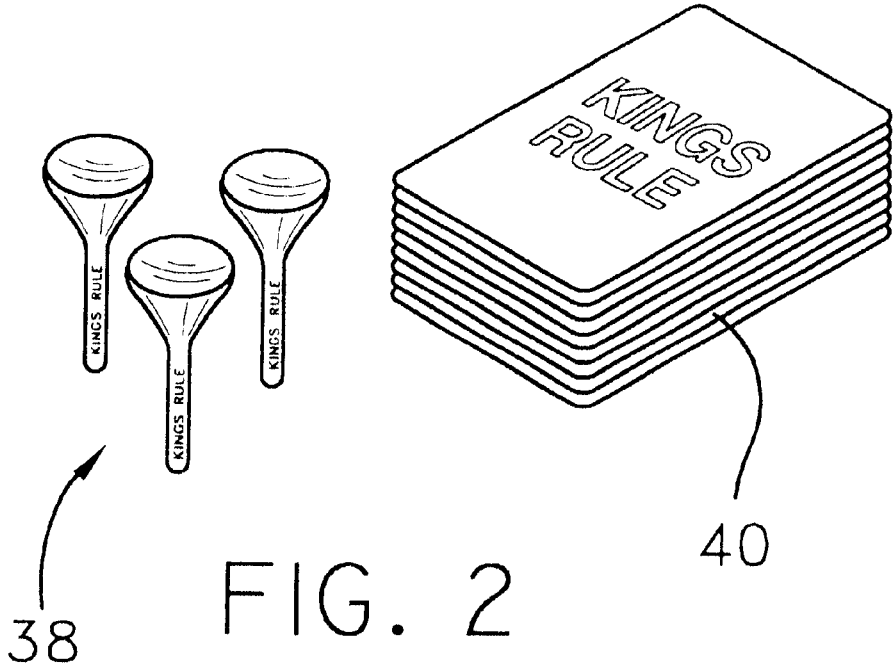
FIG. 2 is a schematic perspective view of game peripherals of the present invention.
Figure 3:
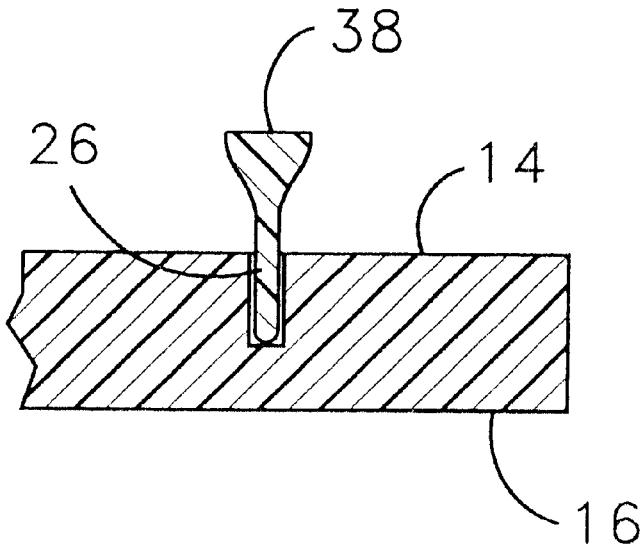
FIG. 3 is a schematic cross-sectional view taken along line 3—3 of the present invention.

With reference now to the drawings, and in particular to FIGS. 1 through 3 thereof, a new game and method of playing the same embodying the principles and concepts of the present invention and generally designated by the reference numeral 10 will be described.

As best illustrated in FIGS. 1 through 3, the game and method of playing the same 10 generally includes a game board 12 having a top surface 14, a bottom surface 16 and perimeter edge 18. The top surface 14 generally has a circular shape.

A game path 20 is positioned on the game board and is continuous about the game board 12. The game path 20 comprises a plurality of game spaces 22, where four of the game spaces are a beginning spaces 24. The beginning spaces 24 are spaced from each other. Each of the game spaces 22 includes a hole 26 extending downwardly into the top surface of the game board 12. The game path 20 has 4 arced portions 28 extending toward a center of the game board and 4 straight portions 30 interspersed between and connecting adjacent pairs of the arced portions 28 such that the game path 20 is generally cross-shaped. Each of the straight portions 30 is located generally adjacent to the perimeter edge 18 of the game board 12. The right-most game space of each of the arced portions 28 defines one of the beginning spaces 24.

A plurality of starting positions 32 is positioned on the top surface 14 of the game board 12 and positioned between the perimeter edge 18 and the game path 20. Each of the starting positions 32 are located generally adjacent to one of the beginning spaces 24. Each of the starting positions 32 includes a set of aligned holes 26 extending into the top surface such that there are five holes in each of the starting positions 32. Each of the starting positions 32 is located between a pair of generally adjacent straight portions 30 of the game path 20. Each of the starting positions 32 is colored a different color.

Each of plurality of ending positions 34 is associated with and positioned generally to the right of one of the beginning spaces 24. Each of the ending positions 34 is colored a color generally matching the color of its associated starting position. Each of the ending positions 34 is between the game path 20 and a central area of the game board 12. The ending positions 34 each include a plurality ending spaces 36. Each of the ending spaces 36 is a hole extending into the top surface 14 and is aligned along a line extending toward the central area.

Each of a plurality of sets of game pieces 38 for moving about the game path has the same color as one of the starting positions. Each of the sets of game pieces 38 includes five game pieces comprising a peg removably positionable in the holes 26.

A conventional a deck of cards 40 is provided having a four suits, each suit extending ace through king.

Rules of the Game

Each player selects a starting position 32 and an associated set of game pieces 38.

The deck 40 is shuffled by a one of the players who deals five cards to each of the players. After the first deal of five cards, the remaining cards are ideally dealt in lots of four cards.

A card is played by each of the players in turn such that each player plays one card from their hand. The card that is played defines a played card.

The player moves a game piece 38 by a player according to their card played. The game piece is moved from the starting position 32 to the beginning space 24 if a player plays an ace or a king. The player may only move a game piece from the starting position to the game path by playing a king or an ace. A game piece is moved 13 game spaces forward on the path if a player plays a king. 12 game spaces forward if a player plays a queen, 11 game spaces forward if a player plays a jack, and 1 game space forward if a player plays an ace. Any game pieces passed by the game piece being moved using a king are positioned back into their starting position including any of the player's own game pieces unless the game piece being passed is in its beginning space 24 in which case the game piece in said beginning space 24 may not be passed. The player who plays a Jack may also switch their game piece with another players game piece 38 but may not switch their game piece with another player's game piece which is positioned in the beginning space 24 by moving player's beginning space 24. The player moves a game piece 38 the number of game spaces forward indicated by number indicia on the card if the played card is a 3, 5, 6, 8, 9 or 10. If a player plays a 4, the game piece is moved backward 4 game spaces. The player moves a game piece on the game board 2 game spaces forward if the played card is a 2 from a black suit, and switches their game piece with another other player's game piece on the game path if the played card is a 2 from a red suit and places the other player's game piece in that players starting position 32. A 2 from a red suit must be played immediately except on the very first hand of the game. The player may divide multiple moves between game pieces adding up to seven game spaces moved forward if the played card is a 7 as long as one of the moved game pieces is moved into one of the ending'spaces 36, otherwise one pawn is moved 7 spaces forward.

A game piece 38 moving on the game path 20 may not move beyond a game piece in a beginning space 24. The game pieces located in beginning spaces 24 are not to be moved by a 2 from a red suit either. In this manner, game pieces 38 in beginning spaces 24 effectively block all movement past that beginning space. A game piece 38 is moved from an occupied game space 22 to its starting position 32 if another game piece 38 finishes its movement in that occupied game space 22.

The game pieces 38 are moved to their associated ending positions 34 from the game path when each of the game pieces 38 has completed traveling around the game path 20. The ending spaces 36 are each counted as game spaces 22 when moving the game pieces 38 such that the game piece 38 must only be moved a number of game 22 and ending 36 spaces indicated by the played card. In other words, the exact number of spaces moved, both game and ending, must be the same as indicated by the card when moving into the ending positions. The game pieces 38 in the ending position 34 may not move beyond another game piece in the ending position.

The cards are re-dealt to each of the players in lots of four when the players have played all cards. The played cards are reshuffled as needed for re-dealing.

The game is won by the first player having all of their game pieces in the associated ending position 34.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

We claim:

1. A method for playing a game comprising the steps of:

providing a game board having a top surface, a bottom surface and perimeter edge, said top surface generally having a circular shape;

providing a game path positioned on said game board, said game path being continuous, said game path comprising a plurality of game spaces, four of said game spaces being a beginning space, said beginning spaces being spaced from each other, each of said game spaces including a hole extending downwardly into said top surface of said game board, said game path having 4 arced portions extending toward a center of said game board and 4 straight portions interspersed between and connecting adjacent pairs of said arced portions such that said game path is generally cross-shaped, each of said straight portions being located generally adjacent to said perimeter edge of said game board, said right most game space of each of said arced portions defining one of said beginning spaces;

providing a plurality of starting positions being positioned on said top surface of said game board and positioned between said perimeter edge and said game path, each of said starting positions being located generally adjacent to one of said beginning spaces, each of said starting positions including a set of aligned holes extending into said top surface such that there are five holes in each of said starting positions, each of said starting positions being located between a pair of generally adjacent straight portions of said game path, each of said starting positions being colored a different color;

providing a plurality of ending positions, each of said ending positions being associated with and positioned generally to the right of one of said beginning spaces, each of said ending positions being colored a color generally matching the color of its associated starting position, each of said ending positions being between said game path and a central area of said game board, each of said ending positions including a plurality ending spaces, each of said ending spaces being a hole extending into said top surface and being aligned along a line extending toward said central area;

providing a plurality of sets of game pieces for moving about said game path, each of said sets of game pieces having the same color as one of said starting positions, each of said sets of game pieces including five game pieces, each of said sets of game comprising a peg being removably positionable in said holes;

providing a deck of cards;

selecting a starting position and an associated set of game piece by each of said players;

shuffling said deck by a one of said players and dealing five cards to each of said players, wherein said cards are dealt in lots of four after a first dealing of cards;

playing a card by each of said players in turn such that each player plays one card from their hand, said card being played defining a played card;

moving a game piece by a player according to their card played, said game piece being moved from the starting position to the beginning space if a player plays an ace or a king, wherein said player may only move a game piece from said starting position to said game path by playing a king or an ace, moving a game piece 13 game spaces forward on said path if a player plays a king, all of said game pieces passed by the game piece being moved using a king are positioned back into their respective starting position unless said game piece being passed is in its beginning space in which case said game piece in said beginning space may not be passed;

moving a game piece 12 game spaces forward if a player plays a queen;

moving a game piece 11 game spaces forward if a player plays a jack or switching a game piece with another player's game piece unless the other player's game piece is positioned in the beginning space;

moving a game piece 1 game space forward if a player plays an ace;

moving a game piece the number of game spaces forward indicated by number indicia on said card if said played card is a 3, 5, 6, 8, 9 or 10;

moving a game piece backward 4 game spaces if said played card is a 4;

moving a game piece on said game board 2 game spaces forward if said played card is a 2 from a black suit;

switching the game piece by the player playing the card with any other player's game piece on the game path if said played card is a 2 from a red suit and moving the other player's game piece into that players starting position unless the other player's game piece is in its own beginning space;

dividing multiple moves between game pieces adding up to seven game spaces moved forward if the played card is a 7 as long as one of the moved game pieces is moved into one of the ending spaces otherwise one pawn is moved 7 spaces forward, wherein a game piece moving on said game path may not move beyond a game piece in a beginning space, moving a game piece from an occupied game space to its starting position if another game piece finishes its movement in that occupied game space;

moving said game pieces to its associated ending position from said game path when said game piece has completed traveling around said game path, said ending spaces being counted as game spaces when moving said game pieces such that said game piece must only be moved a number of game and ending spaces indicated by said played card, said game pieces in said ending position may not move beyond another game piece in said ending position;

re-dealing cards to each of said players in lots of four when said player has played all cards, wherein said played cards are reshuffled as needed for re-dealing; and winning the game by the first player having all of their game pieces in the associated ending position;

choosing by each of said players a partner such that a plurality of teams is defined, said game being won when each of said players of a team having all of their game pieces in the associated ending positions, wherein a first player having all of their game pieces in an ending position may assist a second player on their team by providing said second player the cards being held by the first player.

* * * * *